US008328028B1

(12) United States Patent
Freilich

(10) Patent No.: US 8,328,028 B1
(45) Date of Patent: Dec. 11, 2012

(54) ASSEMBLY FOR THE DISPLAY OF EYEGLASSES AND THE LIKE

(76) Inventor: Joshua Freilich, Santa Fe, NM (US)

( * ) Notice: Subject to any disclaimer, the term of this patent is extended or adjusted under 35 U.S.C. 154(b) by 749 days.

(21) Appl. No.: 11/959,234

(22) Filed: Dec. 18, 2007

Related U.S. Application Data

(60) Provisional application No. 60/870,524, filed on Dec. 18, 2006.

(51) Int. Cl.
*A47F 7/02* (2006.01)
*F16L 3/00* (2006.01)

(52) U.S. Cl. ..... 211/85.1; 248/902; 248/121

(58) Field of Classification Search ..... 211/85.1, 211/13.1, 87.01; 248/902, 229.16, 229.26, 248/121
See application file for complete search history.

(56) References Cited

U.S. PATENT DOCUMENTS 549,396 A * 11/1895 Sanborn ..... 359/809
1,710,847 A * 4/1929 Thursby ..... 248/413
2,713,947 A * 7/1955 Foster ..... 211/85.1
2,826,387 A * 3/1958 Rutten ..... 248/229.26
3,040,881 A * 6/1962 McNeill ..... 211/85.1
3,229,944 A * 1/1966 Everburg ..... 248/220.31
3,891,092 A * 6/1975 Surrette et al. ..... 211/85.1
3,924,750 A * 12/1975 Dunchock ..... 211/85.1
4,558,788 A * 12/1985 Grothaus ..... 211/85.1
4,724,966 A * 2/1988 Benaksas ..... 211/85.1
4,787,520 A * 11/1988 Pearson ..... 211/85.1
4,805,781 A * 2/1989 Tegel ..... 211/85.1
4,830,203 A * 5/1989 Ennis ..... 211/105.2
4,830,480 A * 5/1989 Ennis ..... 351/158
4,890,745 A * 1/1990 Holden ..... 211/85.1
4,976,357 A * 12/1990 Pearson ..... 211/85.1
RE33,596 E * 5/1991 Ennis ..... 211/105.2
5,069,416 A * 12/1991 Ennis ..... 248/231.81
5,137,242 A * 8/1992 Reath ..... 248/309.1
5,176,262 A * 1/1993 Zoueki ..... 211/85.1
5,178,283 A * 1/1993 Ennis ..... 211/4
5,316,252 A * 5/1994 Charnow et al. ..... 248/224.51
5,337,903 A * 8/1994 Wolcovitch et al. ..... 211/85.1
D374,366 S * 10/1996 Eldon et al. ..... D6/567
5,573,217 A * 11/1996 Garvey et al. ..... 248/316.7
5,593,045 A * 1/1997 Eldon et al. ..... 211/85.1
D402,827 S * 12/1998 Ennis ..... D6/466
5,921,409 A * 7/1999 Gerber et al. ..... 211/85.1
5,979,849 A * 11/1999 Williams ..... 248/309.1
6,135,407 A * 10/2000 Havis et al. ..... 248/309.1
6,135,409 A * 10/2000 O'Keeffe ..... 248/314
6,182,840 B1 * 2/2001 Tegel ..... 211/85.1
6,644,608 B1 * 11/2003 Begg ..... 248/229.16
7,134,559 B2 * 11/2006 Zoueki ..... 211/85.1
7,607,627 B1 * 10/2009 Mchatet ..... 248/316.7
2004/0200790 A1 * 10/2004 Zoueki ..... 211/85.1
2006/0226306 A1 * 10/2006 Smith et al. ..... 248/121

FOREIGN PATENT DOCUMENTS

WO WO 9103196 A1 * 3/1991

* cited by examiner

*Primary Examiner* — Jonathan Liu
*Assistant Examiner* — Stanton L Krycinski
(74) *Attorney, Agent, or Firm* — Deborah A. Peacock; Justin R. Jackson; Peacock Myers, P.C.

(57) ABSTRACT

Assembly that displays eyewear in a horizontal manner and allows for adjustment of display positions.

17 Claims, 11 Drawing Sheets

ASSEMBLY FOR THE DISPLAY OF EYEGLASSES AND THE LIKE

CROSS-REFERENCE TO RELATED APPLICATIONS

This application claims priority to and the benefit of the filing of U.S. Provisional Patent Application Ser. No. 60/870,524, entitled "Assembly For The Display Of Eyeglasses and the Like," filed on Dec. 18, 2006, and the specification thereof is incorporated herein by reference.

BACKGROUND OF THE INVENTION

Field of the Invention

Technical Field

Embodiments of the present invention relate to display systems for eyewear and the like.

BRIEF SUMMARY OF THE INVENTION

The preferred embodiment of the present invention is an assembly and method for the display of eyewear comprising: a base for supporting the eyewear; a center bridge extending upwardly from the base, with the center bridge comprising at least one flange; and a support member engaging with at least one flange. The center bridge preferably comprises two flanges and the support member engages with the two flanges. The base comprises at least one stop or ridge for engaging with the eyewear to prevent the eyewear from slipping off the base. The stop includes but is not limited to a ridge.

The base comprises two stops disposed at opposing ends and these stops optionally comprise ridges.

The preferred embodiment of the assembly further comprises a mount in which the support member is disposed. The support member rotatably engages with at least one flange and preferably two flanges. The support member preferably slideably engages with at least one flange. The support member slides perpendicular to the base. Embodiments of the present invention include but are not limited to comprising a plurality of bases disposed on a single support member; a plurality of support members disposed on a single mount.

The method of the present invention for displaying eyewear comprises assembling together: a base for supporting the eyewear; a center bridge extending upwardly from the base, the center bridge comprising at least one flange; and a support member engaging with the at least one flange.

Novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

Further scope of applicability of the present invention will be set forth in part in the detailed description to follow, taken in conjunction with the accompanying drawings, and in part will become apparent to those skilled in the art upon examination of the following, or can be learned by practice of the invention. The objects and advantages of the invention can be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
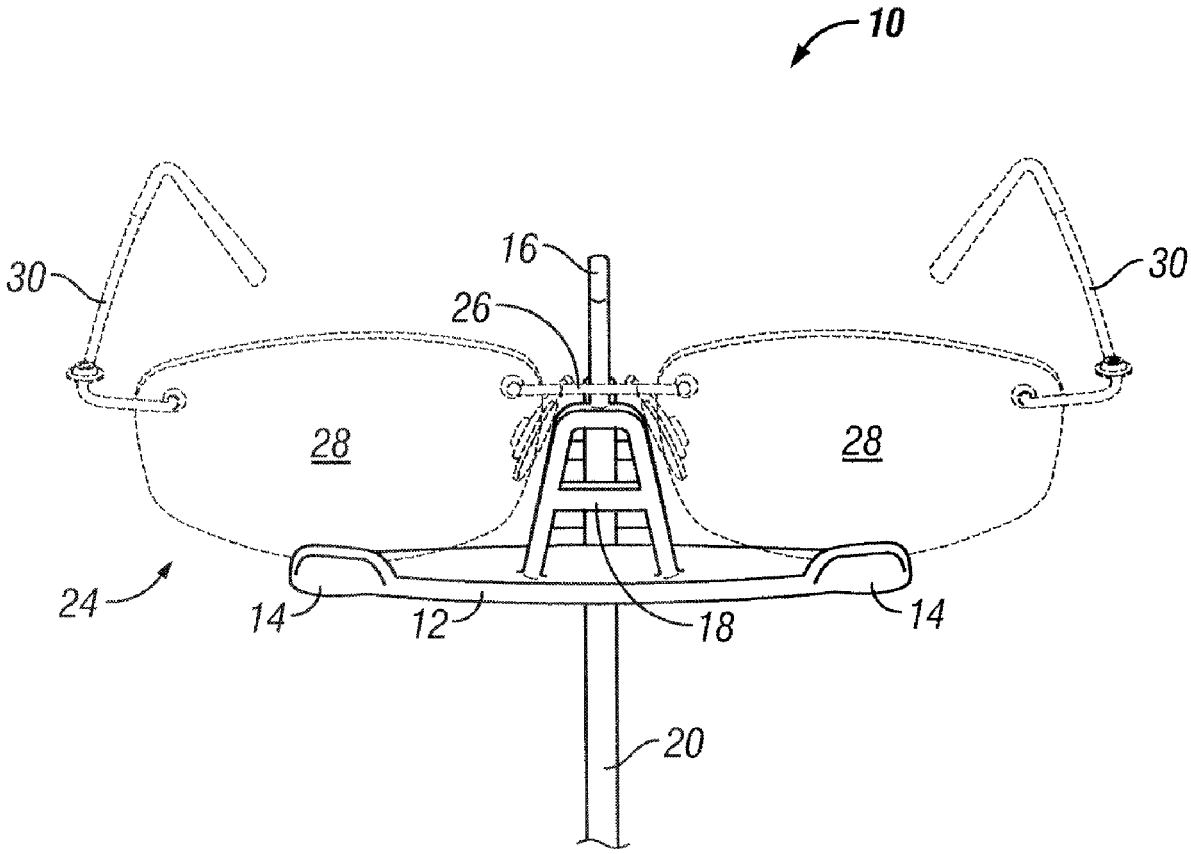
FIG. 1 illustrates a front view of a preferred holder of the present invention.

Embodiments of the present invention relate to display systems especially useful for the eyeglass industry, including the arrangement and display of eyeglass frames and similar products.

The display apparatus preferably allows the products being displayed to be arranged at a substantially horizontal level, providing an aesthetically pleasing appearance for merchandising purposes and the like. Those skilled in the art will readily recognize that the preferred embodiment of the present invention substantially prevents eyewear from leaning while on the display.

Modern glasses are typically supported by pads on the bridge of the nose and by temples placed over the ears. Embodiments of the present invention substantially support the eyewear from the bottom, and not the brow piece of the eyewear. The preferred embodiment of the present invention allows for any size of eyewear to be displayed simultaneously. Preferably, the present invention has components which substantially accommodate any type of eyewear, including but not limited to wrap around or flat bridge eyewear.

The terms "eyewear" and "eyeglasses," as used throughout the specification and claims are intended to include, but is not limited to, any glasses, eyeglasses, eyewear or spectacles with frames bearing lenses, worn in front of the eyes normally for vision correction, eye protection, or for protection from ultraviolet light.

Embodiments of the present invention can be used for any type of eyewear including but not limited to eyeglass frames commonly made from metal, horn or plastic. Any lenses in the frames are also accommodated by the present invention including but not limited to those made from glass, or plastic, including but not limited to allyl diglycol carbonate or polycarbonate.

The present invention is preferably light weight, easy to assemble and disassemble, and is easily shipped and stored.

As can be seen in the drawings, using the present invention, eyewear can be mounted vertically, horizontally, straight or rotated relative to each other. The eyewear can be easily lined up for an aesthetically appealing display.

FIGS. 1-13 illustrate an assembly in accordance with the present invention indicated generally as 10. Assembly 10 preferably comprises support 20 and holder. Holder is preferably made from a rigid material including but not limited to a rigid plastic material and can be opaque, semi-transparent, transparent, clear or colored as will be appreciated by those skilled in the art.

FIG. 1 illustrates a preferred embodiment of holder 10 which comprises a substantially planar base portion 12 having a pair of ridges 14 extending upwardly from forward opposed edges of base portion 12. Center post 16 extends upwardly from receiver 18, which itself extends upwardly from base portion 12. Receiver 18 is adapted to dispose holder 10 on and/or to a display support bar 20. Display support bar 20 is preferably an elongated rod or similar apparatus that is adapted to cooperate with receiver 18. Receiver 18, in a non-limiting example, includes a pair of substantially L-shaped flanges 19, 19' (best seen in FIGS. 8-13) adapted to receive display support bar 20. L-shaped flanges 19, 19' extend outwardly from center bridge 16, are preferably perpendicular to display bar 20 and receive display bar 20 in opening 17 formed between center post 16 and flanges 19, 19'. FIG. 1 also illustrates eyeglasses 24 including bridge of eyeglasses 26, lenses 28, and ear pieces 30.

Figure 2:
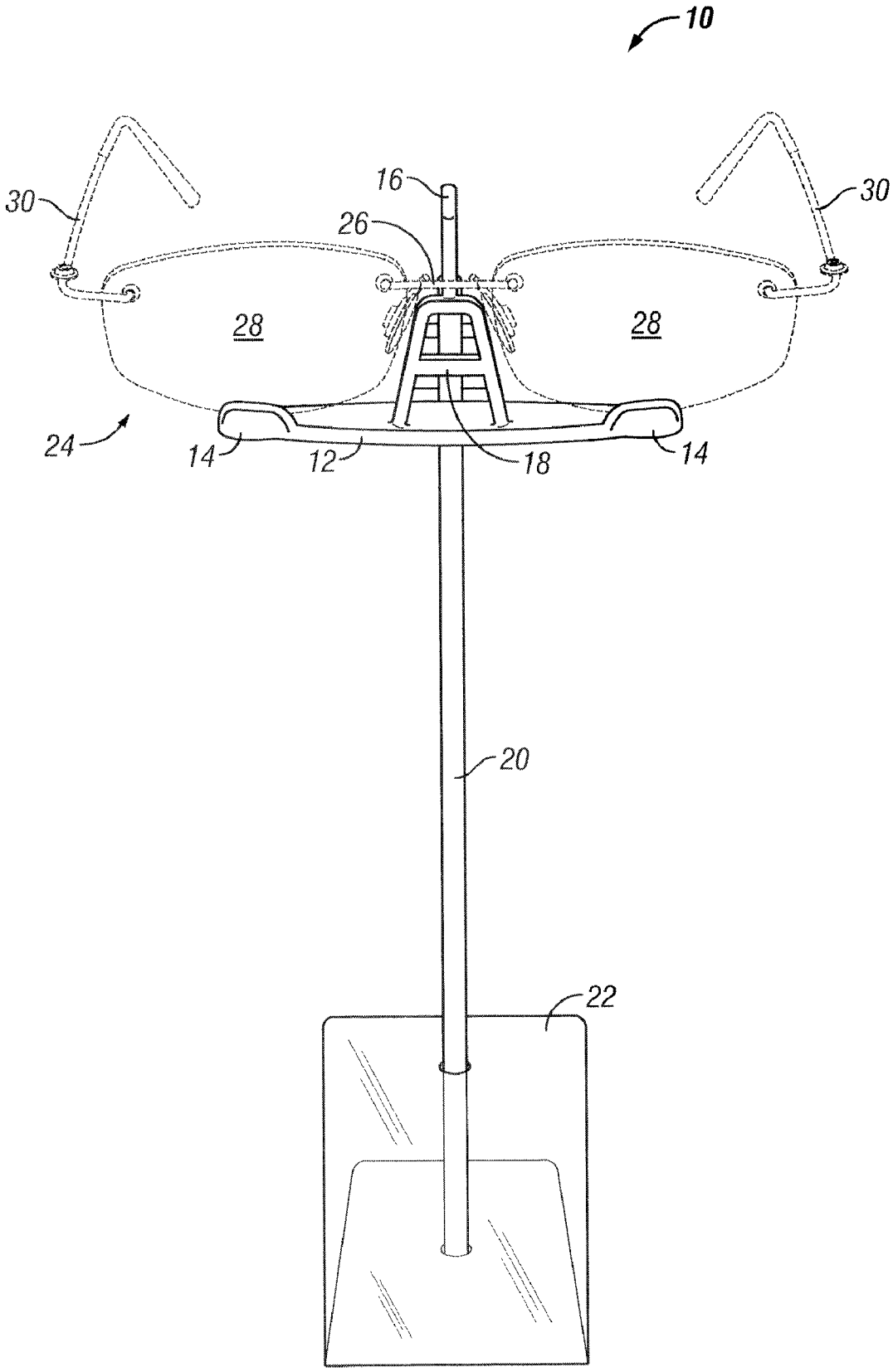
FIG. 2 illustrates a front view of the preferred assembly of the present invention showing the FIG. 1 with a support mount.
Figure 3:
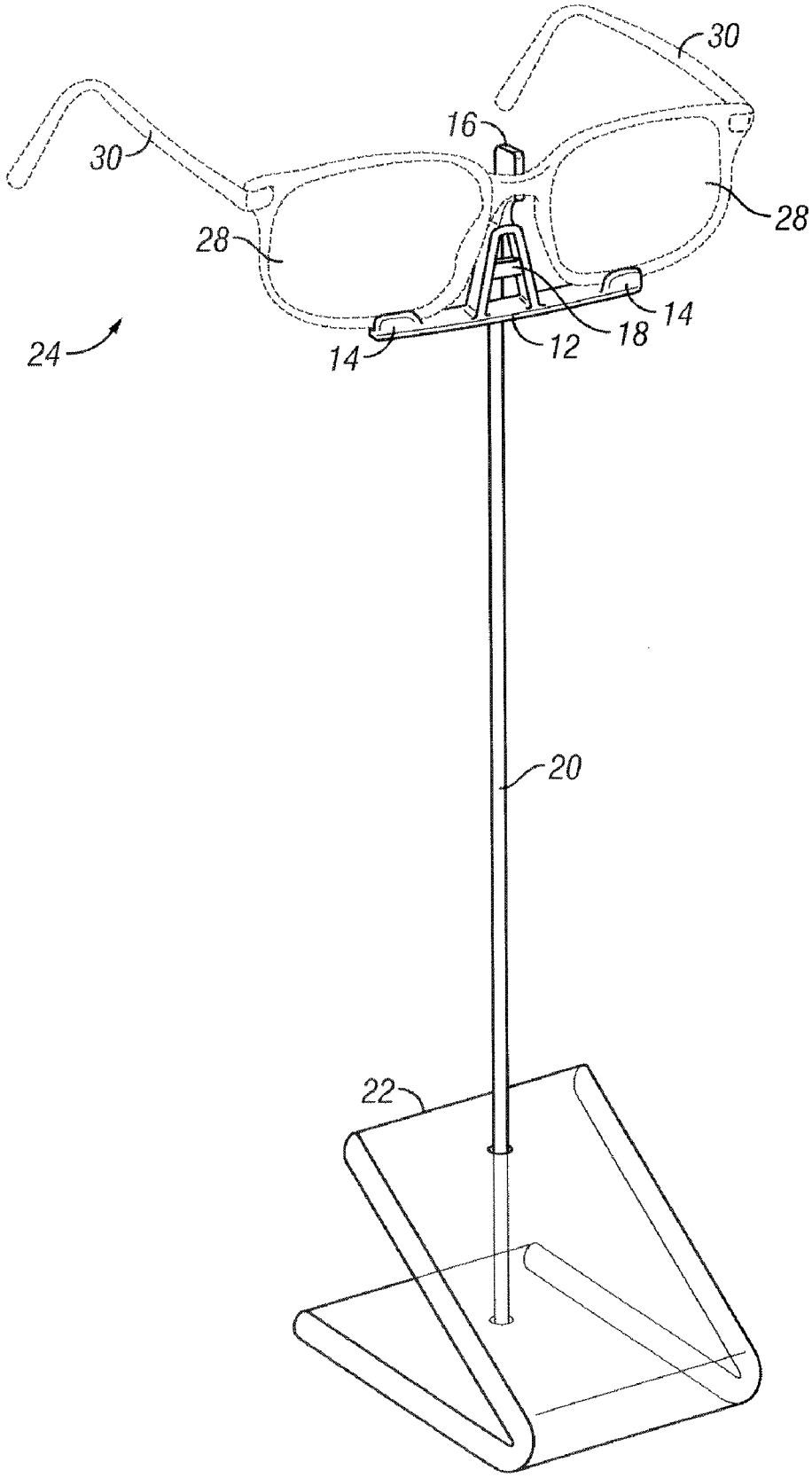
FIG. 3 illustrates a side view of the assembly of FIG. 2.
Figure 4:
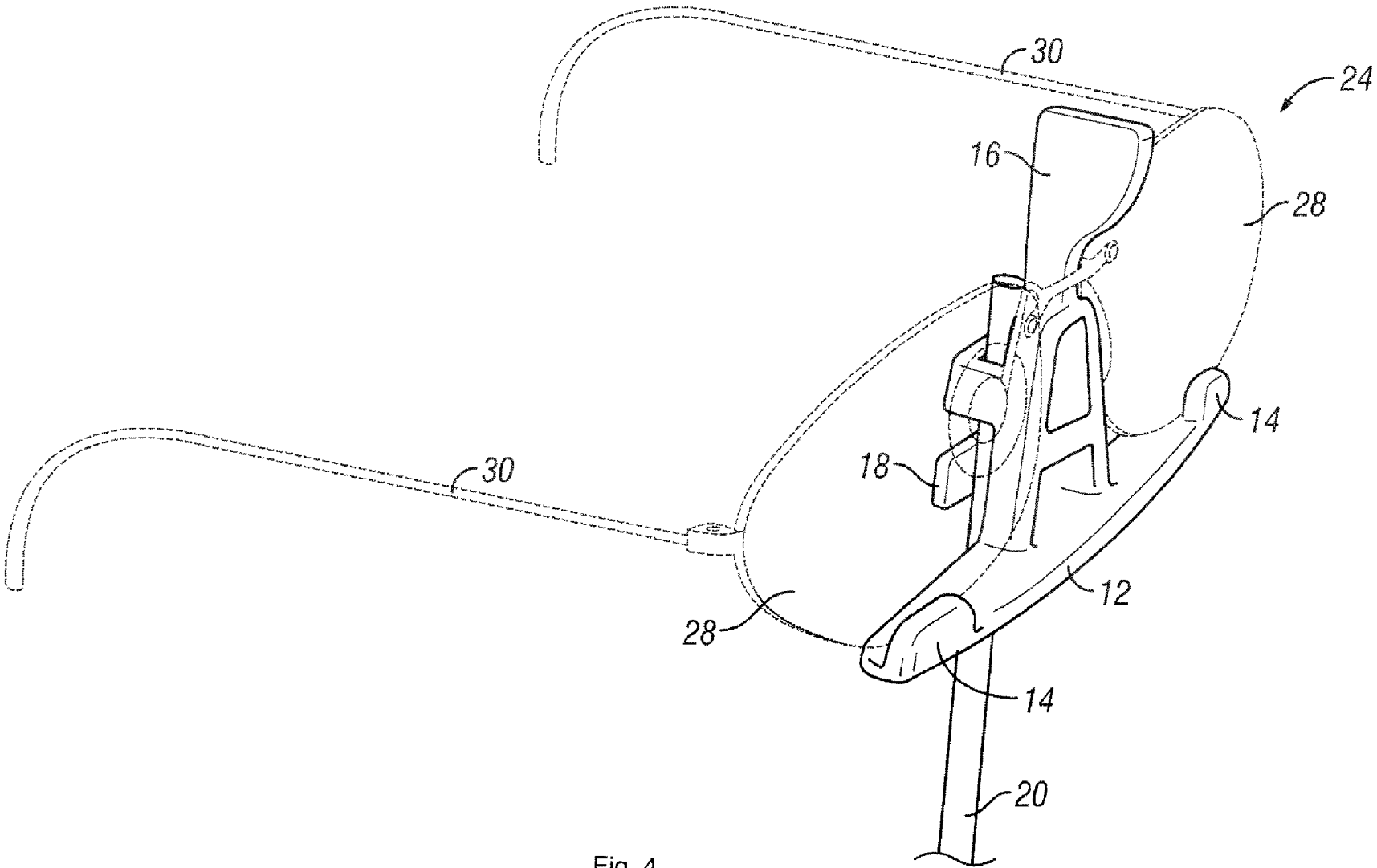
FIG. 4 illustrates a side view of the holder of FIG. 1.

An end of display bar 20 is adapted to be disposed in support mount 22, as illustrated in FIGS. 2 and 3, that provides a base from which the eyeglasses can be displayed. The size, shape, material, and weight of base or support mount 22 are preferably selected based on the anticipated use and quantity of the holder and support bars to be attached to the base. Optionally, a single display bar can be disposed on the base (see FIGS. 2 and 5) or a plurality of display bars can be disposed on a base (see FIG. 7).

A pair of eyewear, indicated generally at 24, is disposed on assembly 10 (as illustrated in FIGS. 1-3). Eyewear 24 includes bridge 26 extending between pair of lenses 28 and having ear pieces 30 extending rearwardly from lenses 28, as is well known in the art. When eyewear 24 are displayed on assembly 10, bridge 26 of eyewear 24 preferably engages with a forward surface of center post 16 and the bottom surface of lenses 28 preferably rests on an upper surface of base portion 12. Ridges 14 preferably engage with an outer surface of lenses 28 to aid, in conjunction with bridge 26 engaging with center post 16, in retaining eyewear 24 in a substantially horizontal position with respect to assembly 10 and prevent eyewear 24 from leaning or rotating.

Center post 16 preferably comprises a notch, indentation or opening for engaging with bridge 26 of eyewear 24 to prevent bridge 26 from moving with respect to center post 16 and to provide a surface upon which bridge 26 can rest. Center post 16 preferably comprises a curve. This curve accommodates different sizes and shapes of frames and bridges of eyeglasses. Center post 16 and this curve preferably act as an "adjuster" allowing substantially any eyewear size and shape to remain in a substantially horizontal plane on base portion 12. The sweep of the curve produces the following effect. As the size of the eyewear gets larger and the bridge and the temples both increase in the horizontal position in relation to the bottom of the support where the eyewear rests, the curve in the post changes to keep the temple horizontal. This is important when there is a grouping of different size frames so that the temples are not tilting up and down. With this curve they are all horizontal.

Figure 5:
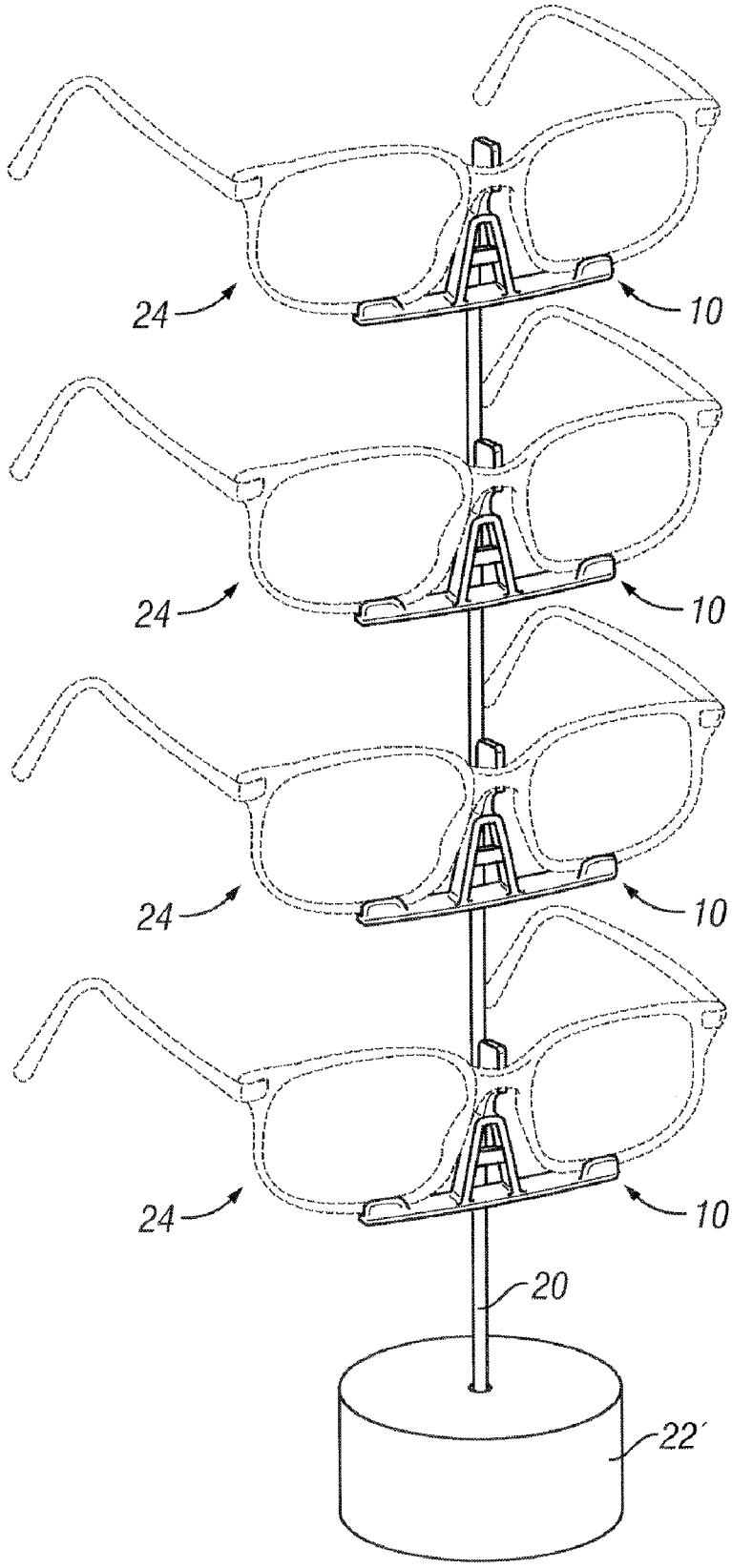
FIG. 5 illustrates a plurality of holders of the present invention attached to a single mount.
Figure 6:
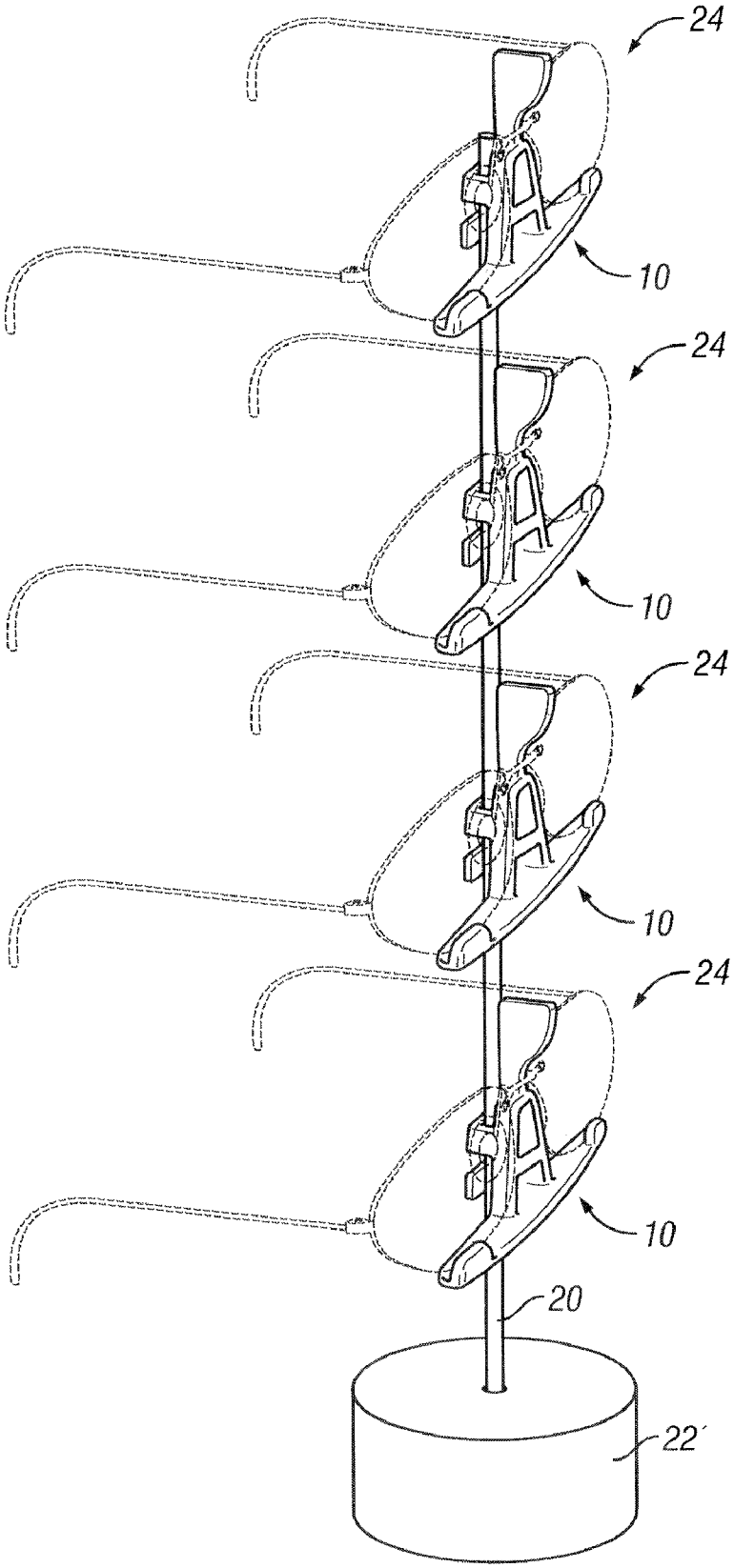
FIG. 6 illustrates a side perspective view of the assemblies of FIG. 5.

Referring now to FIGS. 5 and 6, a plurality of assemblies 10 in accordance with the present invention are illustrated, each holder attached to display bar 20. An end of support bar 20 is disposed in an alternative embodiment of support mount 22' (FIG. 5). Support mount 32 (FIG. 7) is a more robust member than support mount 22 based on the anticipated use and quantity of the display apparatus to be attached to support mount 32. The support mount can be any shape or size and can support one or more support bars.

Figure 7:
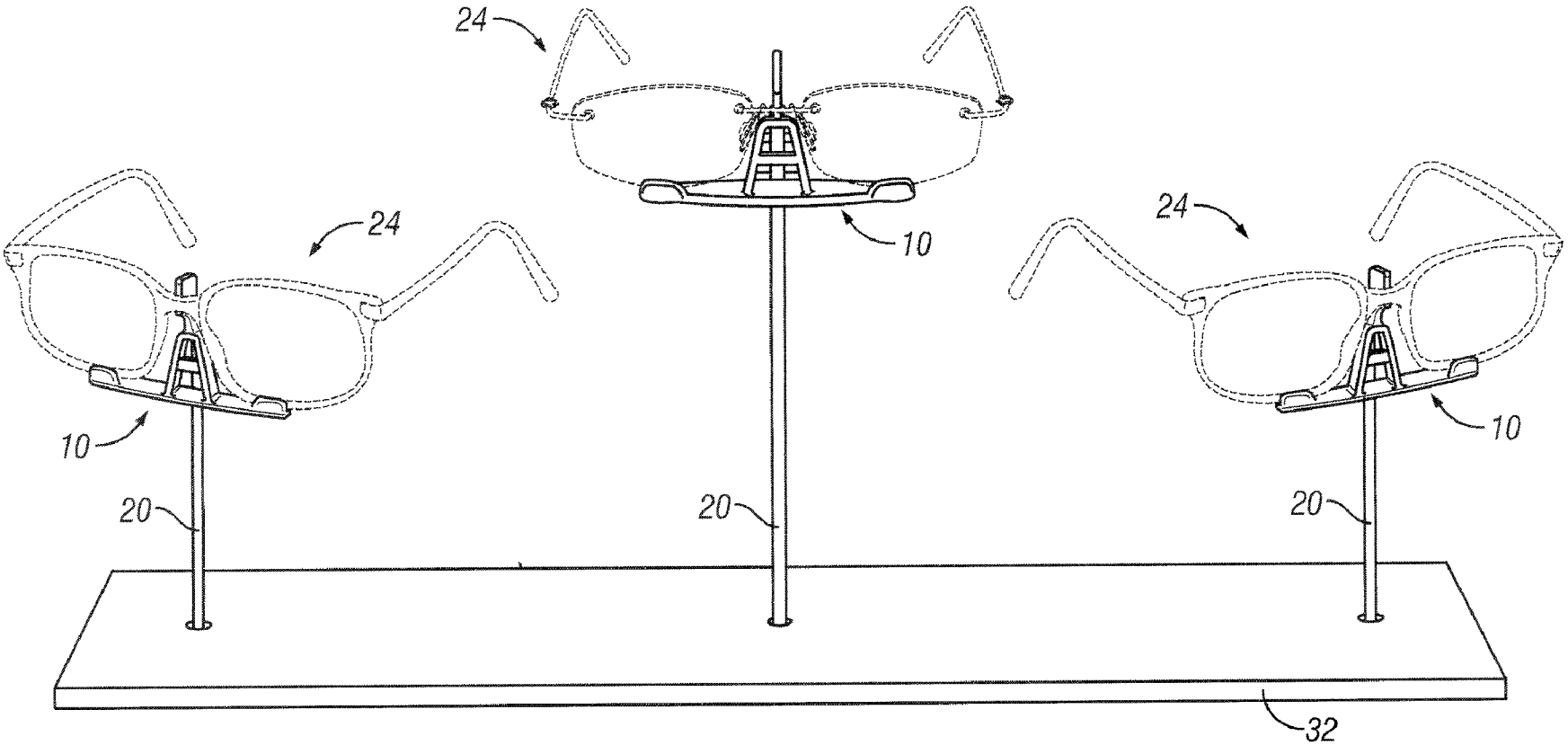
FIG. 7 illustrates a plurality of holders of the present invention attached to individual display supports.

Referring now to FIG. 7, plurality of holders and assemblies 10 in accordance with the present invention are illustrated attached to respective display bars 20. An end of each of display bars 20 is disposed in an alternative embodiment of support mount 32. Support mount 32 can optionally be elongated with respect to support mount 22 (see FIG. 3) and support mount 22' (see FIG. 5), and is preferably adapted to receive a plurality of display bars 20.

Figure 8:
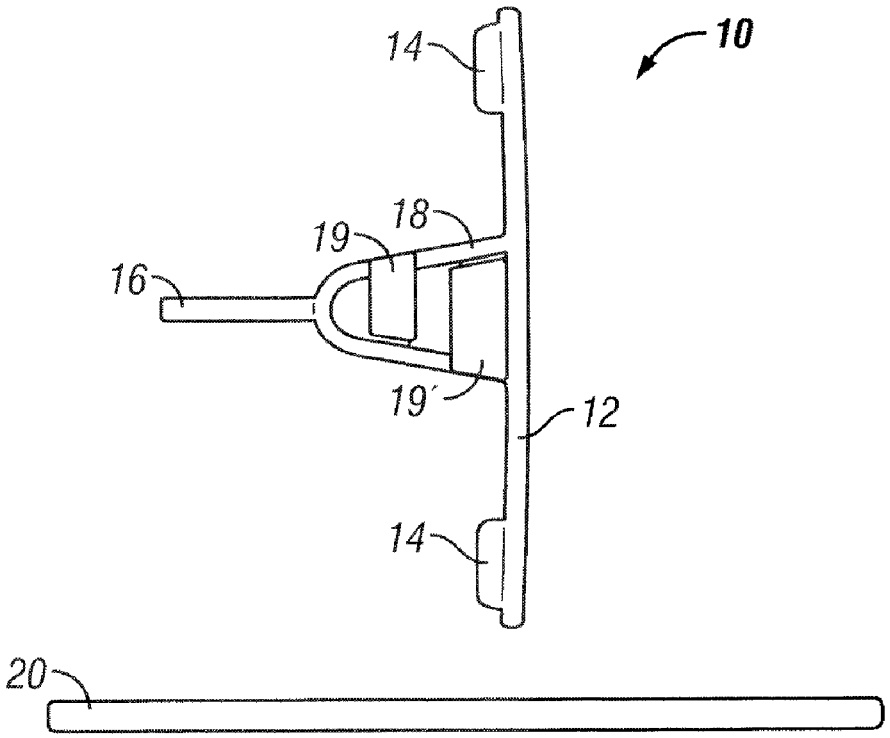
FIG. 8 illustrates a top view of the holder of FIG. 1 showing a support bar adjacent the holder.

FIG. 8 illustrates assembly 10 with holder separate from and perpendicular to support bar 20. Ridges 14 are disposed on base portion 12 from forward opposed edges of base portion 12. Center post 16 preferably extends upwardly from base portion 12 and is preferably wider at the top terminal end to allow for ease of handling. Upper flange 19 and lower flange 19' are disposed on receiver 18.

Figure 9:
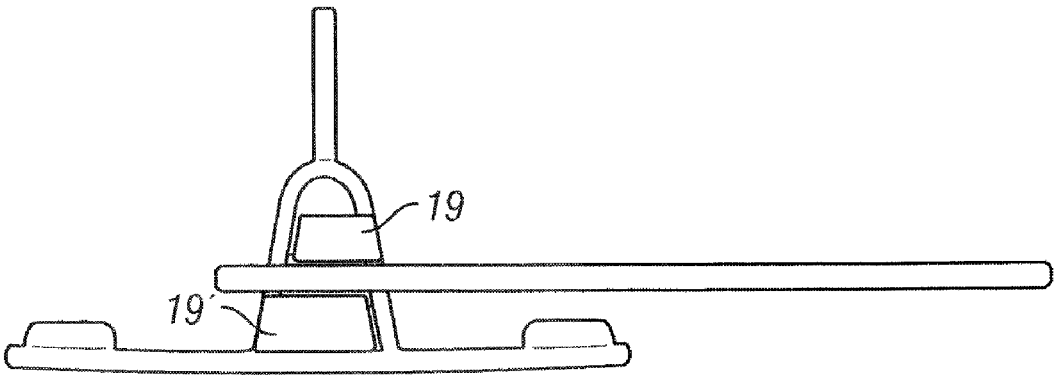
FIG. 9 illustrates the support bar of FIGS. 1 and 8 at a horizontal position to the holder.
Figure 10:
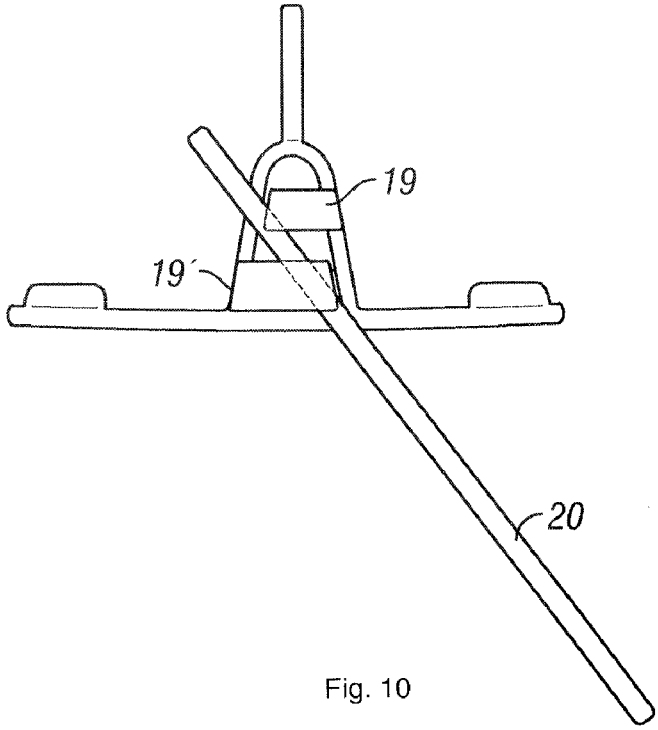
FIG. 10 illustrates the support bar of FIG. 9 at an angle and rotating into the holder.
Figure 11:
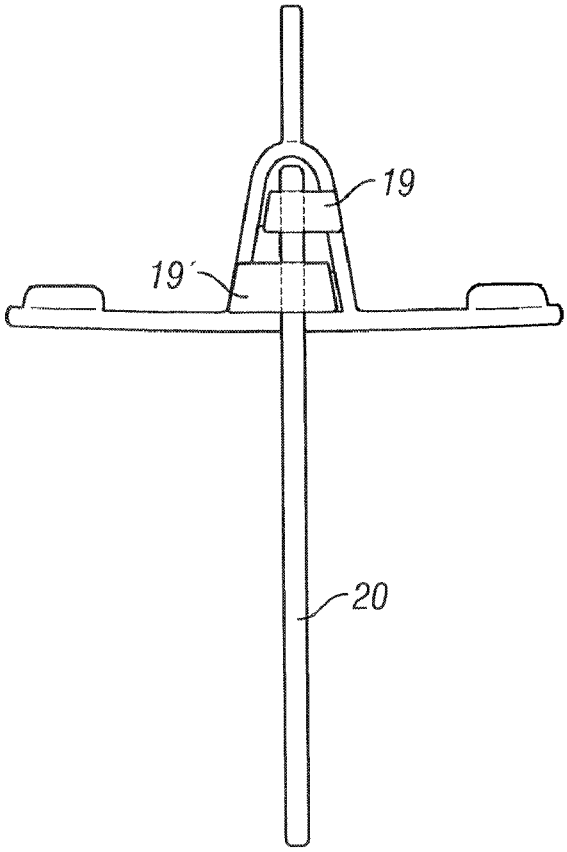
FIG. 11 illustrates the support bar of FIG. 10 substantially inserted and rotated into the holder.
Figure 12:
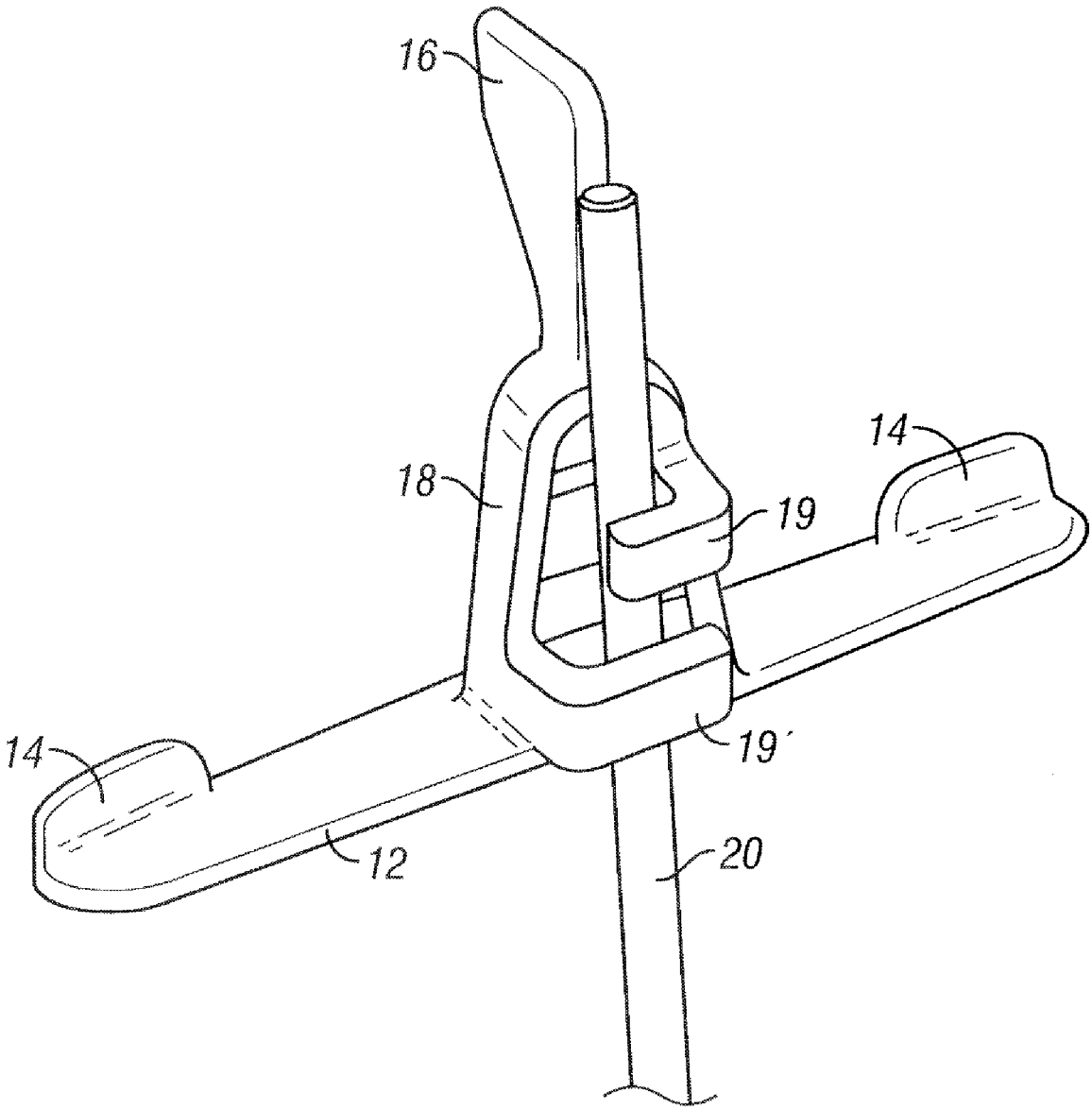
FIG. 12 illustrates the support bar of FIG. 11 inserted and upward into the positioned holder.
Figure 13:
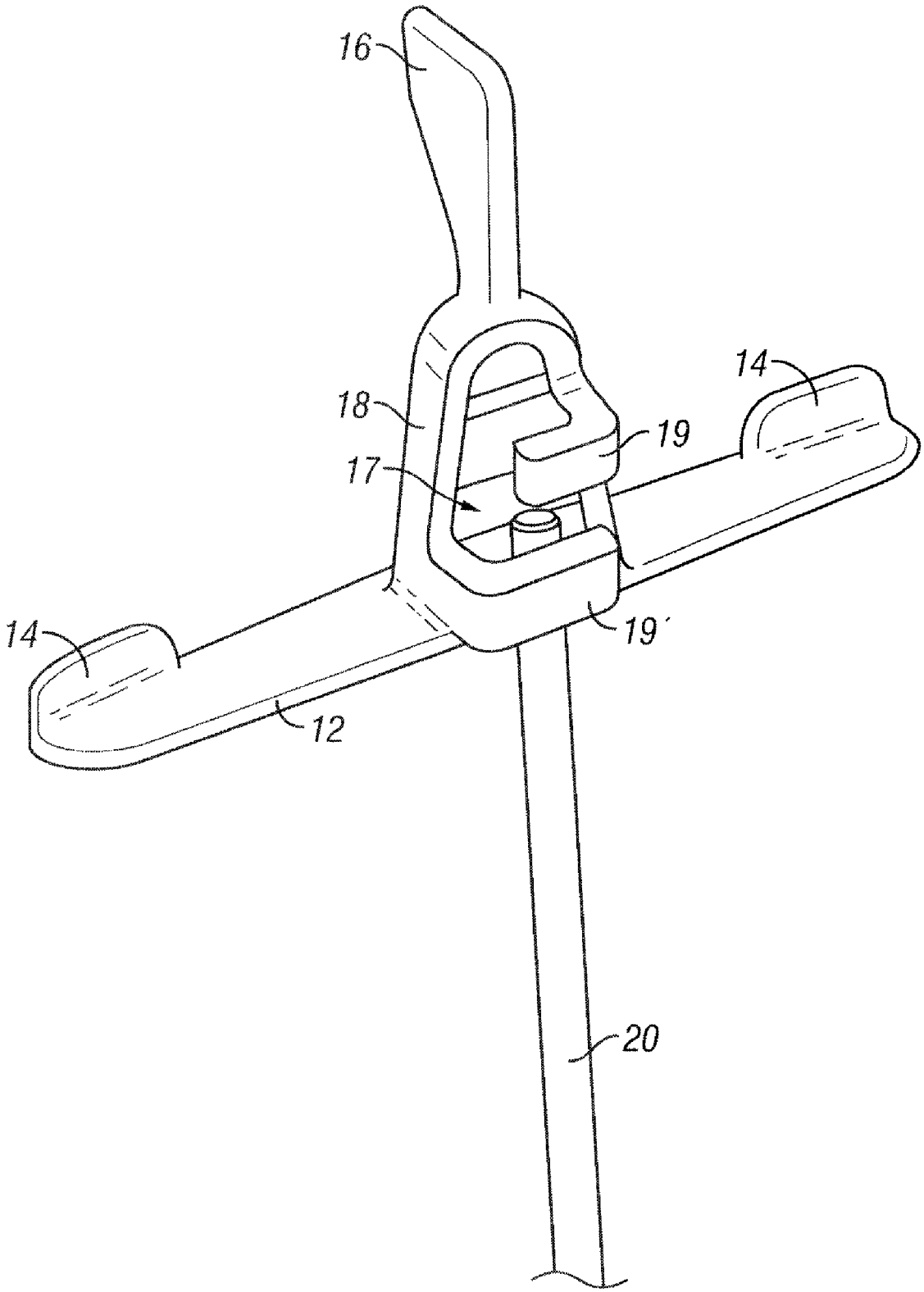
FIG. 13 illustrates the support bar of FIG. 11 substantially inserted into the holder but positioned lower in the holder.

To dispose and/or insert support bar 20 into receiver 18, support bar is preferably first positioned horizontally between flanges 19 and 19' (see FIG. 9). Support bar 20 is then rotated so that the top of support bar 20 rotates under upper flange 19 and a lower portion of support bar 20 rotates under lower flange 19' (see FIG. 10). This rotation continues until support bar 20 locks into place in a substantially vertical position held by flanges 19, 19' (see FIG. 11). Support bar 20 can be moved vertically into place between flanges 19, 19' in any desired position (including but not limited to higher (see FIG. 12) or lower (see FIG. 13)). This enables one to adjust the height of each display of the eyewear.

The assembly is light weight, aesthetically pleasing, and can be easily and advantageously configured to display a single or multiple products, such as eyewear 24 or the like, as required or desired by the user of the product. Alternative embodiments include but are not limited to a plurality of eyewear displayed on a single bar, a plurality of eyewear displayed on multiple bars, and/or a plurality of eyewear on a single bar next to a single pair of eyewear displayed on a single bar.

Embodiments of the assembly may be free mounted, or hung. As those skilled in the art will readily recognize, the substantially horizontal support of eyewear can allow for any combination of mounting techniques to be used in conjunction with the embodiments of the present invention. Alternative embodiments comprise adding attachments including but not limited to adhesives, magnets and the like.

While the preferred embodiment of the invention is directed to the eyeglass industry, the invention is also useful in any industry or art that requires a display apparatus that can be configured to display a single or multiple products in an aesthetically pleasing and efficient manner.

INDUSTRIAL APPLICABILITY

The invention is further illustrated by the following non-limiting example.

Example 1

An assembly in accordance with the present invention as described was constructed. The assembly was constructed of transparent, rigid, lightweight plastic and molded to accommodate eyeglasses. The assembly was disposed on a metal bar that was inserted into a plastic rigid support mount.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An assembly for the display of eyewear comprising:
- a base plate;
- a support bar extending upwardly above said base plate;
- a movably positionable eyewear holder comprising:
  - an eyewear base for supporting the eyewear;
  - a support bar receiver extending upwardly from said eyewear base;
  - a center bridge post extending upwardly from said support bar receiver;
  - said support bar receiver comprising at least one flange;
  - said flange engagable with said support bar; and
  - a front surface of said center bridge post comprising a curve;
  - said curve comprising a non-uniform radius of curvature about an axis; and
  - said axis of said curve disposed at least substantially perpendicular with a primary axis of said support bar.

2. The assembly of claim 1 wherein said support bar receiver comprises two flanges and said support bar engages with said two flanges.

3. The assembly of claim 1 wherein said eyewear base comprises at least one stop for engaging with the eyewear to prevent the eyewear from slipping off said eyewear base.

4. The assembly of claim 3 wherein said stop comprises a ridge.

5. The assembly of claim 1 wherein said eyewear base comprises two stops disposed at opposing ends.

6. The assembly of claim 1 wherein said support bar rotatably engages with said flange.

7. The assembly of claim 2 wherein said support bar rotatably engages with said two flanges.

8. The assembly of claim 1 wherein said support bar slideably engages with said flange.

9. The assembly of claim 8 wherein said support bar slides perpendicular to said eyewear base.

10. The assembly of claim 1 comprising a plurality of movably positionable eyewear holders disposed on a single support bar.

11. The assembly of claim 1 comprising a plurality of support bars extending from said base plate.

12. A method of displaying eyewear comprising:
- assembling together:
  - a base platform;
  - a support bar extending upwardly from said base platform;
  - a movably positionable eyewear holder, the holder comprising:
    - an eyewear base for supporting the eyewear;
    - a support bar receiver extending upwardly from said eyewear base;
    - a center bridge post extending upwardly from the support bar receiver;
    - the support bar receiver comprising at least one flange;
    - the flange engagable with the support bar; and
    - a front surface of the center bridge post comprising a curve having an axis which is at least substantially perpendicular with a primary axis of the support bar; and
    - the curve comprising a non-uniform radius of curvature about said axis; and
    - disposing eyewear onto the movably positionable eyewear holder.

13. The method of claim 12 wherein the support bar receiver comprises two flanges and the support bar engages with the two flanges.

14. The method of claim 12 wherein the support bar rotatably engages with the flange.

15. The method of claim 12 wherein the support bar slides perpendicular to the eyewear base.

16. The method of claim 12 comprising assembling multiple movably positionable eyewear holders on a single support bar.

17. The method of claim 12 comprising disposing multiple support bars in a single base plate.

* * * * *